United States Patent [19]

Mizuno et al.

[11] Patent Number: 4,714,415

[45] Date of Patent: Dec. 22, 1987

[54] SCROLL COMPRESSOR WITH CLOSED COMPRESSION SPACES HAVING VALVES TO REDUCE STARTING TORQUE

[75] Inventors: Takao Mizuno; Naoshi Uchikawa; Akira Murayama; Takahiro Tamura; Ryoichi Kuroshima, all of Shimizu, Japan

[73] Assignee: Hitachi, Ltd., Tokyo, Japan

[21] Appl. No.: 893,177

[22] Filed: Aug. 5, 1986

[30] Foreign Application Priority Data

Aug. 27, 1985 [JP] Japan ..... 60-186625

[51] Int. Cl.[4] ..... F04C 18/04; F04C 29/10

[52] U.S. Cl. ..... 418/14; 418/55

[58] Field of Search ..... 418/14, 15, 55; 417/279

[56] References Cited

U.S. PATENT DOCUMENTS 4,389,171 6/1983 Eber et al. ..... 418/15

4,497,615 2/1985 Griffith ..... 418/55

FOREIGN PATENT DOCUMENTS 57-76287 5/1982 Japan ..... 418/55

60-162093 8/1985 Japan ..... 418/14

*Primary Examiner*—John J. Vrablik

*Attorney, Agent, or Firm*—Antonelli, Terry & Wands

[57] ABSTRACT

A scroll compressor comprises an orbiting scroll and a fixed scroll, each of which includes a spiral wrap. These orbiting and fixed scrolls define between their wraps a plurality of close spaces at symmetrical positions. These closed spaces are moved toward the center of the scrolls by means of orbital motion of the orbiting scroll relative to the fixed scroll for reducing their capacities to compress fluid confined therein. Upon starting the compressor, some of the spaces which are in mid course of compressing and the other closed spaces which locate at the downstream side just before the communication with a discharge port, are communicated with each other through valves which open when pressure in the closed spaces at the upstream side is higher than that in the closed spaces at the downstream side, whereby a loading torque upon starting is decreased.

4 Claims, 5 Drawing Figures

SCROLL COMPRESSOR WITH CLOSED COMPRESSION SPACES HAVING VALVES TO REDUCE STARTING TORQUE

BACKGROUND OF THE INVENTION

The present invention relates to a scroll type compressor and, more particularly to an arrangement for reducing a load upon starting of the scroll.

In a conventional scroll compressor, an orbiting scroll generally comprises an end plate and a spiral wrap located on the end plate in upstanding posture, with a rear side of the end plate having a bearing for orbital motion and a self-rotation preventing mechanism for the orbiting scroll. A fixed scroll also includes an end plate and a spiral wrap located thereon in upstanding position in the same way as the orbiting scroll, with the fixed scroll having a suction port and a discharge port formed in the outer periphery and the center portion of the end plate, respectively.

The orbiting scroll and the fixed scroll are assembled together with their wraps facing inwardly and held in interposed relationship between the fixed scroll and a frame of the compressor.

In the scroll compressor described above, when the orbiting scroll executes an orbital movement or revolution without the rotation about its own axis, the spaces defined by the end plates and the wraps of the orbiting and fixed scrolls are gradually reduced in their capacities as they move toward the center of the scrolls, so as to compress gas which has been drawn in from the suction port and deliver the compressed gas through the discharge port. That is, the gas confined within the spaces at the outer periphery of the wraps is progressively compressed, as the spaces move toward the center of the scrolls, to a constant capacity ratio. In the case of an usual compressor for an air conditioner, the capacity ratio is set about 2.5 to 4. Thus, the suctioned gas is compressed until it attains a predetermined pressure level. Also, in the compressor for an air conditioner, an inlet pressure and an outlet pressure are balanced during the period of stopping operation, with balanced pressure being two or three times as high as the usual suction pressure.

However, when the compressor is restarted, because it compresses the gas of the balanced pressure to its capacity ratio, the pressure in the compressed spaces is two or three times higher as compared with the pressure in an ordinary operation. Therefore, the starting load becomes large and sometimes it becomes almost impossible to start operation of the compressor. In, for example, U.S. Pat. No. 4,389,171 a method for reducing a load upon starting a compressor is proposed.

SUMMARY OF THE INVENTION

An object of the present invention is to provide an improved scroll fluid machine which can reduce a starting load.

According to the present invention, a scroll compressor is provided including an orbiting scroll and a fixed scroll each having an end plate and a spiral wrap formed on the end plate in upstanding position, in which both of the scrolls are assembled together with their wraps facing inwardly to each other, the orbiting scroll executes an orbiting motion relative to the fixed scroll, so that a plurality of closed spaces, defined at symmetrical locations by the wraps and end plates of the scrolls, are successively reduced in capacity as they move toward the center of the scrolls, and communicate with a discharge port provided in the fixed scroll after the reduction in capacity. Two valve chambers are formed at symmetrical positions on the end plate of the fixed scroll, sealing flanges are provided to close the valve chambers, first and second communication ports are provided to open into each valve chamber for communicating with a closed space in mid course of compression and communicating with another closed space of minimum capacity which is further advanced toward the discharge side of the compressor than the former closed space and locates just prior to a communication with the discharge port, and valve plates for opening and closing the respective first communication ports are provided on respective inner walls of the sealing flanges.

In a preferred form, the valve chamber is formed by a recessed portion provided in the end plate of the fixed scroll and the sealing flange tightly secured to the recessed portion by fastener such as, for example, bolts.

Preferably, the valve plate is U-shaped, and one end of the valve plate is secured by, for example, bolts on the inner wall of the sealing flange, while the other end is spring biased so as to close the first communication port.

Preferably, the recessed portion, defining the valve chamber, is formed into a circular or rectangular shape.

In accordance with the scroll fluid machine of the present invention, upon starting, bypass flows can be established, from closed spaces through passage means into the closed spaces of the minimum capacity while the closed spaces defined by the wraps and the end plates, thereby reducing a loading torque upon a starting of the compressor.

DETAILED DESCRIPTION OF PREFERRED EMBODIMENTS

Figure 1:
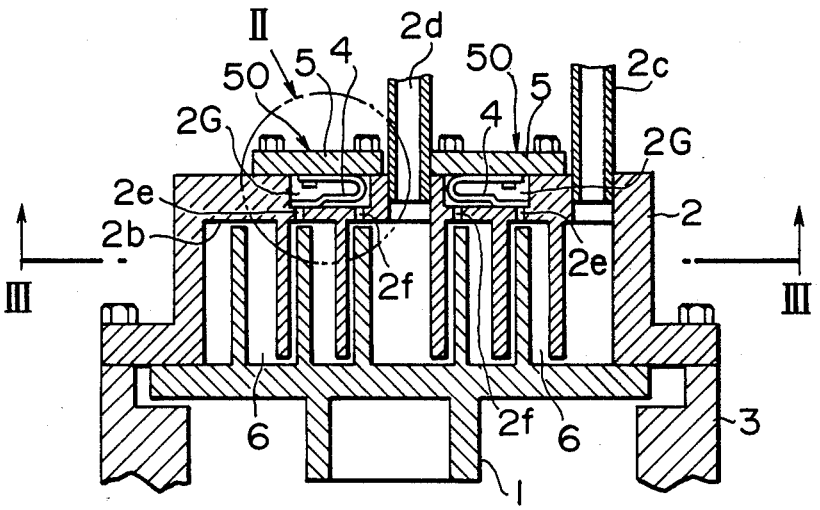
FIG. 1 is a cross-sectional view showing a scroll compressor according to the present invention.

Referring now to the drawings wherein like reference numerals are used throughout the various views to designate like parts and, more particularly, to FIG. 1, according to this figure, a scroll compressor is provided with two valve devices 50 on a fixed scroll 2, with the valve devices 50 comprising first and second communication ports *2e*, *2f*, a valve chamber *2g*, a valve 4, and a sealing flange 5. The valve chamber *2g* includes a circular or rectangular recessed portion, and is formed at an end plate *2b* of the fixed scroll 2. The valve 4 is secured at one end of the sealing flange 5 by a fastener means such as, for example, a screw *4a*, and has a U-shaped configuration, with the valve being capable of opening and closing the associated first communication port *2e*. The sealing flange 5 hermetically seals the upper side of the valve chamber 2G by fastener means such as, for example, screws *5a*. A suction portion *2c* is provided in the fixed scroll 2.

Figure 2:
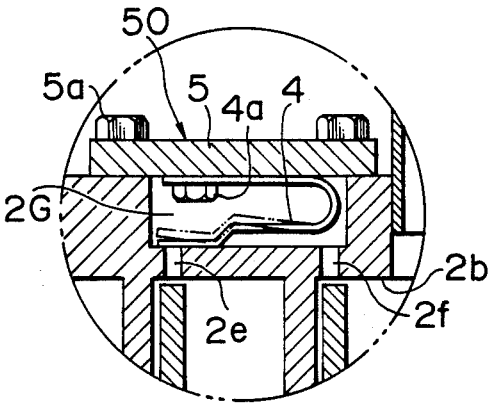
FIG. 2 is an enlarged view of the portion designated by II in FIG. 1.

In FIG. 2, the valve 4 is illustrated by a solid line in the condition of closing the first communication port *2e* and, in broken line, a condition of the opening of the first communication port *2e*. The first and second communication ports 2e, 2f are provided at such positions in the end plate 2b of the fixed scroll 2 as shown in FIG. 3.

Figure 3:
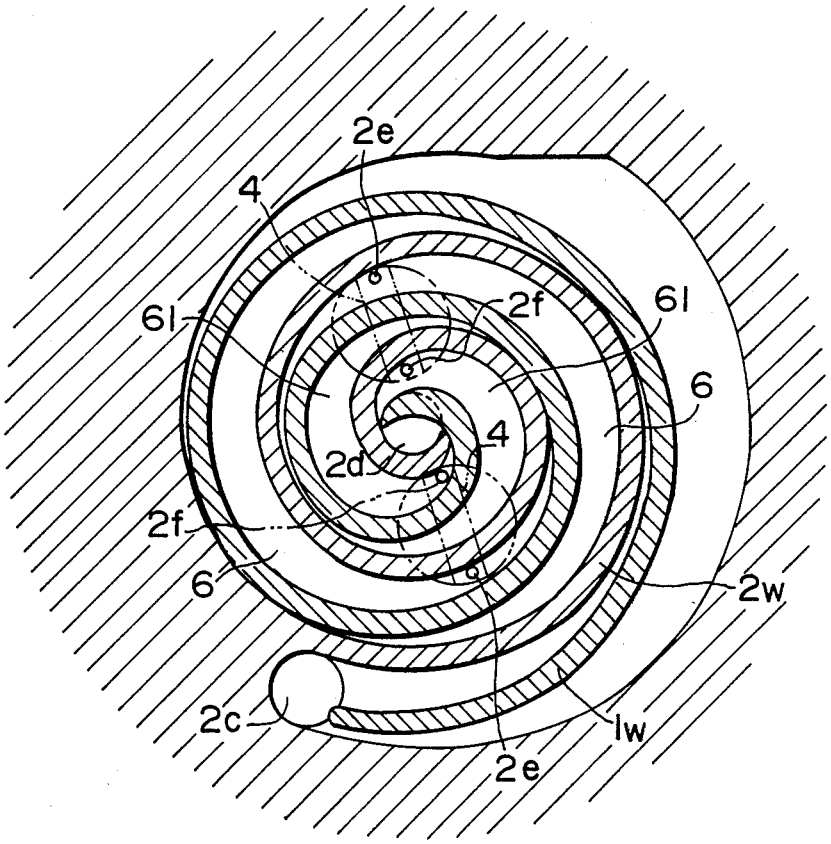
FIGS. 3, 4 and 5 are cross-sectional views of the present invention.

As shown in FIG. 3, each of the first communication ports 2e is formed at a position opening into a closed space 6 defined between an orbiting scroll 1 and the fixed scroll 2, with each second communication port 2f opening at a position in communication with a closed space 61, hereinafter referred to as a minimum capacity closed chamber, defined between the orbiting scroll 1 and the fixed scroll 2 as just prior to the communication with a discharge port 2d.

FIG. 3 illustrates the positional relationship between a wrap 1w of the orbiting scroll 1 and the wrap 2w of the fixed scroll 2 when the closed spaces in the most immediate proximity to a center of the oribiting scroll 1 form the minimum capacity closed chambers 61. The closed spaces in the scroll compressor are always symmetrically defined in pairs so that two sets of valve devices are provided at two respectively symmetrical positions.

Figure 4:
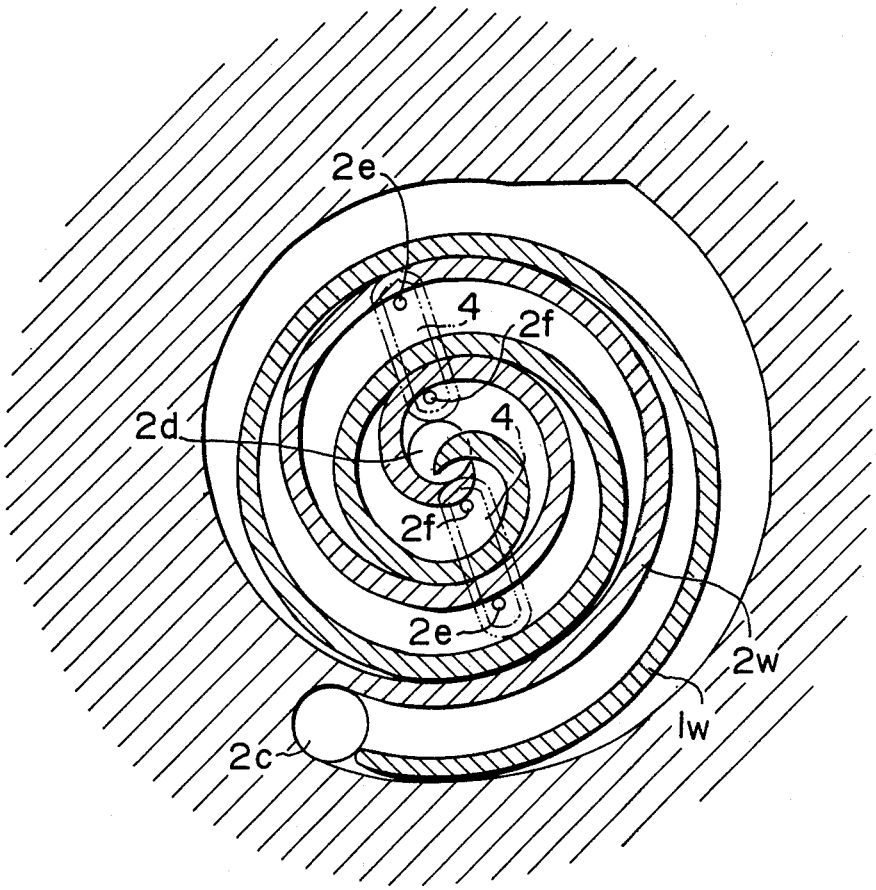

FIG. 4 illustrates a condition in which the compressing process of the scroll compressor according to the present invention is further advanced from the condition illustrated in FIG. 3, that is, FIG. 4 illustrates the condition wherein the closed spaces 6, forming the minimum capacity closed chambers 61 in FIG. 3, communicate with the discharge port 2d to enable a discharging operation.

Figure 5:
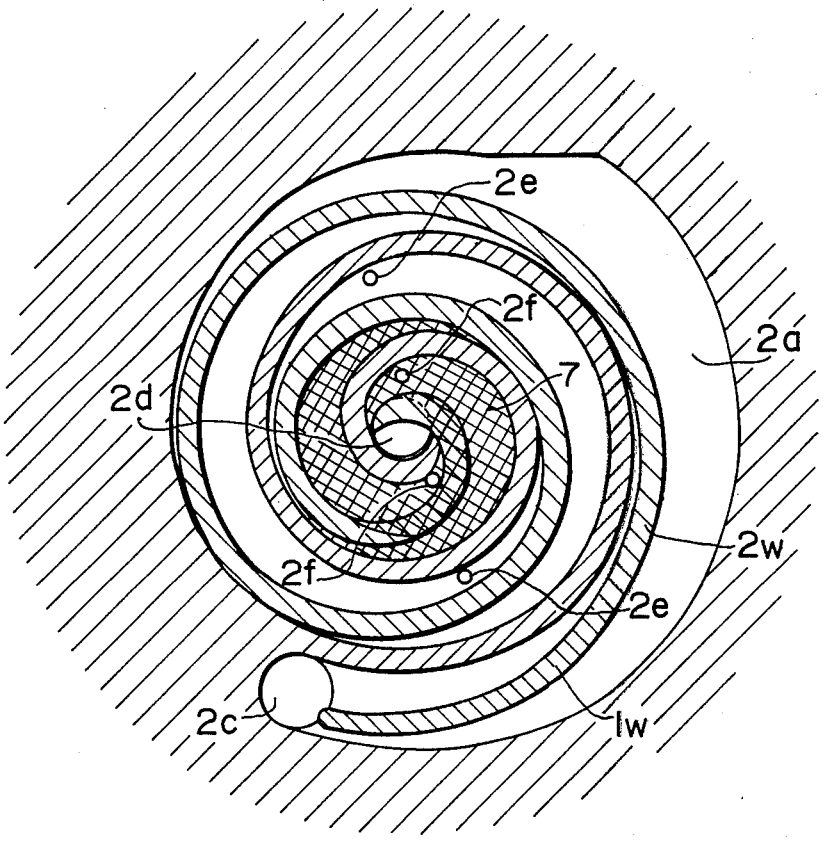

In FIG. 5, the orbiting scroll 1 and fixed scroll 2 are in the same positional relationship for forming the minimum capacity closed spaces 6 as shown in FIG. 3, and a lattice lined portion 7 illustrate the region in which the minimum capacity closed spaces 6 will communicate with the communication ports prior to a discharge of fluid through the discharge port 2d. Consequently, the second communication ports 2f may be arranged so as to open at any position within the lattice lined portion 7. A suction chamber 2a is defined between the orbiting scroll 1 and the fixed scroll 2 to communicate with the suction ports 2c. Upon starting of the compressor, when the pressure in the closed spaces 6 in which the first communication ports 2e open is higher than the pressure in the minimum capacity closed chambers 61 in which the first communication ports 2f open, the pressure in the valve chambers 2G is equal to the pressure in the respective closed spaces 61 because the valve chambers 2G always communicate with the respective second communication ports 2f. Accordingly, each valve 4 opens the associated first communication port 2e by a differential pressure as shown by the broken line in FIG. 2. In other words, when the pressure in the closed spaces 6 is higher than the pressure in the minimum capacity chambers 61, the valves 4 open to enable the passage of fluid flow from the closed spaces 6 to the respective minimum capacity closed chambers 61. The minimum closed capacity chambers 61 are usually shut off from the discharge ports (FIG. 3), but in a certain positional relationship between the fixed scroll 2 and the orbiting scroll 1 as shown in FIG. 4, the minimum capacity closed chambers 61 may communicate with the discharge port 2d. That is to say, according to the invention, when the pressure in the closed spaces 6 is higher than the pressure in the minimum capacity closed chambers 61, it is possible to pass the fluid from the closed spaces 6 to the discharge port 2d through minimum capacity chambers 61. Thus, an unload operation enabling the compressor to omit a part of the predetermined compression process and then discharge, can be carried out. Accordingly, a reduction of the load upon starting the compressor becomes possible. On the other hand, in the ordinary compressing process the pressure in the minimum capacity closed chambers 61 is higher than the pressure in the closed spaces 6, so that the valves 4 are held in a closed condition for effecting ordinary compression.

As described above, according to the present invention the compression ratio upon starting the compressor may be decreased and a reduction of the starting load may be attained.

What is claimed is:

1. A scroll compressor including an orbiting scroll means and a fixed scroll means, each of said scroll means including an end plate and a spiral wrap formed on said end plate in an upstanding position, said orbiting and fixed scroll means being assembled together with wraps thereof meshing inwardly with each other, and said orbiting scroll means is driven to execute an orbital motion relative to said fixed scroll means so that a plurality of closed spaces defined at symmetrical positions by the wraps and end plates of said orbiting and fixed scroll means are successively reduced in capacity while moved toward a center of said fixed and orbiting scroll means, and communicate with a discharge port provided in said fixed scroll means after the reduction in capacity, wherein two valve chamber means are symmetrically formed at positions on the end plate of said fixed scroll means, sealing flange means are provided for closing said valve chamber means, first and second communication port means are provided and open into each valve chamber means for communicating with a closed space in mid course of a compression stage and for communicating with another closed space of a minimum capacity which is further advanced toward a discharge side of the compressor than the closed space in mid course of the compression stage and located just before a communication with the discharge port, and valve plate means for opening and closing said respective first communication port means are provided on inner walls of said sealing flange means.

2. A scroll compressor according to claim 1, wherein each of said valve chamber means includes a recessed portion formed in the end plate of the fixed scroll means and said sealing flange means is tightly secured to the recessed portion by fastening means.

3. A scroll compressor according to claim 1, wherein each of said valve plate means has a U-shape, and one end of said valve plate means is secured by a fastening means on the inner wall of an associated sealing flange means, and another end of said valve plate means is biased by a spring force so as to close the first communication port means.

4. A scroll compressor according to claim 2, wherein said recessed portion has one of a circular or rectangular configuration.

* * * * *